United States Patent [19]

West

[11] Patent Number: 4,524,518

[45] Date of Patent: Jun. 25, 1985

[54] UTILITY KNIFE

[75] Inventor: Robert F. West, West Simsbury, Conn.

[73] Assignee: The Stanley Works, New Britain, Conn.

[21] Appl. No.: 503,749

[22] Filed: Jun. 13, 1983

[51] Int. Cl.[3] ..... B26B 1/00

[52] U.S. Cl. ..... 30/330; 30/2

[58] Field of Search ..... 30/2, 125, 151, 155, 30/160, 161, 164, 330, 331; 224/232, 233; 145/61 J, 62, 63; 35/161

[56] References Cited

U.S. PATENT DOCUMENTS

| | | | |
|---|---|---|---|
| 953,421 | 3/1910 | Holmes | 30/330 |
| 1,629,412 | 5/1927 | Relich | 30/330 |
| 1,829,499 | 10/1931 | Boos | 30/330 |
| 1,997,992 | 4/1935 | Bates, Jr. | 30/317 |
| 2,376,887 | 5/1945 | Walters | 30/330 |
| 2,478,668 | 8/1949 | Shepard et al. | 30/330 |
| 3,380,159 | 4/1968 | Winston | 30/293 |
| 3,604,113 | 9/1971 | Cuscovitch | 30/331 |
| 3,660,895 | 5/1972 | West | 30/162 |
| 3,906,625 | 9/1975 | Gringer | 30/125 |
| 3,927,473 | 12/1975 | Braginetz | 30/164 |
| 3,942,249 | 3/1976 | Poehlmann | 30/161 X |
| 4,005,525 | 2/1977 | Gringer | 30/125 |
| 4,261,104 | 4/1981 | Cuscovitch | 30/331 |

FOREIGN PATENT DOCUMENTS 1413679 11/1975 United Kingdom .

*Primary Examiner*—Douglas D. Watts

*Attorney, Agent, or Firm*—Prutzman, Kalb, Chilton & Alix

[57] ABSTRACT

A utility knife comprises a pair of complementary opposing elongated body sections. The body sections are pivotally connected intermediate handle and blade retaining portions. The body sections interlock by a tongue/slot engagement. A releasable locking means in the handle portion employs a button slidable in transverse openings.

18 Claims, 6 Drawing Figures

FIG. 4
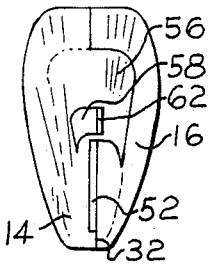
FIG. 3
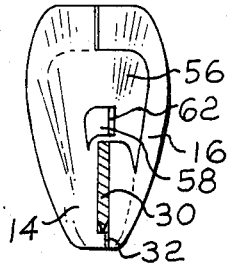
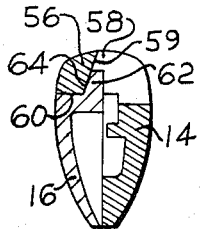
FIG. 5
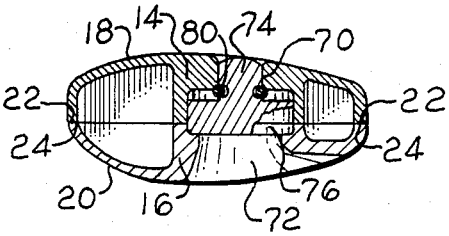
FIG. 6

UTILITY KNIFE

BACKGROUND OF THE INVENTION

This invention relates generally to utility knives, and more particularly, this invention relates to utility knives having a detachable blade.

The utility knife of the present invention relates to utility knives of a type such as disclosed in U.S. Pat. No. 3,509,627 issued to Richard Gilbert et al, U.S. Pat. No. 3,660,895 issued to Robert F. West, and U.S. Pat. No. 4,068,375 issued to Richard H. Rathbun et al, all of which patents are assigned to the assignee of the present invention. The utility knives disclosed in the aforementioned patents generally comprise a pair of elongated mating handle members which are assembled to provide a knife holder having at one end a handle and at the other end a blade retaining portion which terminates in an opening through which a blade projects to present a cutting edge. The foregoing utility knives further include a means intermediate the blade opening and the handle portion for pivoting the elongated mating portions relative to each other so that the blade may be replaced and/or access may be had to a blade storage area within the handle portion of the knife.

The present invention is directed to a new and improved utility knife having a knife holder assembly which is adapted to retain a detachable blade in a non-retractable mode. The holder assembly is also adapted to be releasably locked so that opposing body sections may pivot relative to one another to thus allow the blade to be replaced and to provide access to a blade storage compartment.

BRIEF SUMMARY OF THE INVENTION

Briefly stated, the invention in a preferred form comprises a pair of complementary opposing elongated body sections. The body sections are pivotally connected so that the sections are pivotally moveable between an open position for replacing a blade and a closed position wherein the knife is in operational condition. The knife has a handle portion and a blade retaining portion terminating at the front tip of the knife in a forwardly facing blade opening. The pivot means are intermediate the handle and blade retaining portions. One of the body sections has a transverse shoulder which extends rearwardly from the front tip of the knife and is adjacent the blade retainer means. A slot is defined in the shoulder. The other body section has a recess which mates with the shoulder and a tongue which is receivable in the slot to interlock the body sections when the body sections are pivoted to a closed position. A locking means in the handle portion of the knife releasably secures the body sections in a closed position.

The pivot means is preferably a spring loaded pivot joint. The handle portion further comprises a receptacle for storing blades. The locking means employs a button which is slidable between complementary transverse openings in each of the body sections to secure the body sections in a closed position.

The tongue and the slot are spaced rearwardly from the blade opening. The blade opening has a uniform width which is dimensioned to be slightly less than the thickness of a blade to be mounted in the blade retainer means. The knife handle is adapted so that a blade may be mounted in a blade retainer means and secured therein by the interlocking body sections cooperating to bias against the sides of the blade.

An object of the invention is to provide a new and improved utility knife which can be readily pivoted to an open position for replacing and/or repositioning a blade and which in a closed position prevents blade slippage and inadvertent separation of body segments during heavy duty use.

Another object of the invention is to provide a new and improved utility knife which is relatively easy to manufacture and assemble and which requires a minimum number of components.

A further object of the invention is to provide a new and improved utility knife which is particularly adapted for facile blade removal and replacement.

A still further object of the invention is to provide a new and improved utility knife having an attractive appearance and a simplified durable structure.

Other objects and advantages of the present invention will become apparent from the drawings and the detailed description.

BRIEF DESCRIPTION OF THE DRAWINGS

FIG. 3 is a front end view of the knife of FIG. 1 in a closed position without a blade;

FIG. 4 is a front end view of the knife of FIG. 1 in a closed position with a blade mounted therein;

FIG. 5 is a sectional view taken along the line 5—5 of FIG. 1 when the knife is in a closed position; and FIG. 6 is an enlarged sectional view taken along the line 6—6 of FIG. 1 when the knife is in a closed position;

DETAILED DESCRIPTION OF THE DRAWINGS

Figure 1:
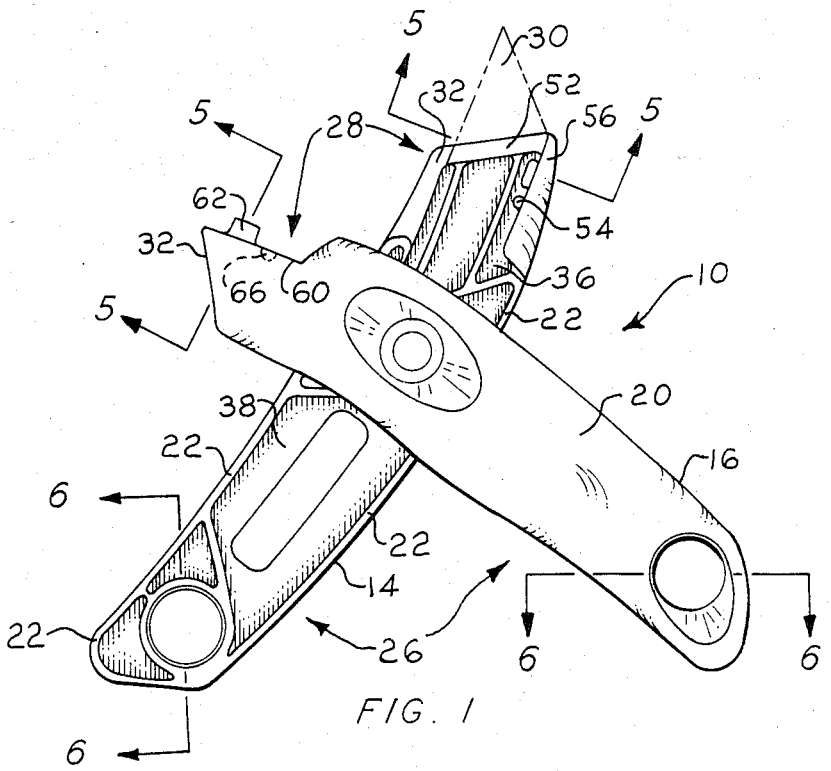
FIG. 1 is a side view of the utility knife of the present invention illustrating the knife in an open position.

With reference to the drawings, a utility knife 10 incorporating the present invention generally has a slightly angled, substantially hollow elongated holder composed of two cooperating opposed body sections 14 and 16 which receive a blade 30 (shown in dashed lines).

The body sections 14 and 16 have peripheral side walls 18 and 20 which terminate in abutting shoulders 22 and 24. Shoulders 22 and 24 define mating surfaces which lie in a single longitudinal parting plane traversing the longitudinal centerline of the holder.

Body sections 14 and 16 are pivotally movable in a swivel fashion between a closed position, such as illustrated in FIGS. 3 and 4, an open position such as illustrated in FIG. 1. In a closed position, body sections 14 and 16 cooperate to provide a knife having a rear handle portion 26 and a forward blade retainer portion 28. A blade 30 is mounted in the blade retainer portion 28 to project outwardly and forwardly from the front tip of the holder to present a cutting edge. The exterior of the body sections 14 and 16 are suitably contoured and dimensioned to facilitate manually gripping of the handle portion 26 and to facilitate employment of the knife to perform various cutting tasks by way of appropriate manipulation and application of the cutting edge of the blade 30. The utility knife is particularly adaptable for use in conjunction with a detachable blade having a single cutting edge. The front tip 32 of the knife is a generally beveled configuration relative to the body of the holder so that the cutting edge of blade 30 extends forwardly proximate the bottom of the knife. In a preferred form, the blade assumes a conventional trapezoidal shape so that the upper non-cutting edge of the blade is essentially entirely or nearly entirely received within the holder and the blade projects forwardly to terminate at a lower forward blade apex.

Figure 2:
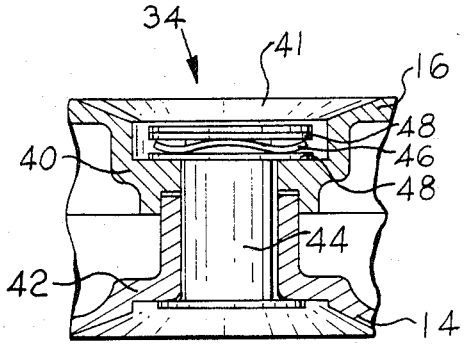
FIG. 2 is an enlarged sectional view of the central pivot of the knife of FIG. 1 wherein the knife is in a closed position.

With further reference to FIGS. 1 and 2, pivot 34 forms a pivot axis which extends transverse to the longitudinal parting plane defined by the mating surfaces of body sections 14 and 16. Pivot 34 is intermediate the forward blade retainer portion 28 and the rear handle portion 26 so that in the open position of FIG. 1 an internal blade recess 36 and an internal blade storage compartment 38 are revealed and access therewith facilitated. Pivot 34 in a preferred form includes interlocking bosses 40 and 42 which extend inwardly from body sections 16 and 14, respectively, to rotatably interlock. Bosses 40 and 42 form a transverse bore interposed between opposing indentations 41 and 43 formed in the exterior surfaces of body sections 16 and 14. A pivot pin in the form of an eyelet 44 extends through the bore and receives at one end a wave spring 46 interposed between a pair of washers 48 to form a spring biased pivot which acts to bias together body sections 14 and 16. Cylindrical recesses may also be provided at the ends of the transverse bore to accommodate the eyelet, washers and wave spring.

Blade recess 36 is adapted to receive and secure blade 30 in position. Blade recess 36 is partially defined by opposed retainer members of body sections 14 and 16. With reference to FIG. 3, blade recess 36 terminates at a forward end in a blade opening 52 which opens forwardly from the front tip 32 of the knife. Blade opening 52 has a substantially rectangular shape and is dimensioned to have a uniform thickness as will be described hereinafter. A projection 54 is further provided at the upper portion of the blade recess to mate with a complementary notch in a corresponding blade 30. Projection 54 cooperates with the corresponding notch of blade 30 to define the longitudinal projection of the blade relative to the blade opening and the forward tip of the holder to thus determine the length of the exposed cutting edge of the blade and to further firmly secure the blade in a given longitudinal position relative to the knife holder. The blade with which the present knife is preferably employed has a notch or may have a plurality of notches. THe blade is located and longitudinally positioned by aligning a notch on the blade with the projection 54.

With further reference to FIG. 1 and FIG. 5, a shoulder 56 projects transversely relative to abutting shoulder 22 at the top front portion of body section 14 and extends rearwardly from the front tip 32 of body section 14. A slot 58 having an engagement surface 59 spaced outwardly relative to abutting shoulder 22 is located in shoulder 56. The forward upper portion of body section 16 is contoured to define a recess 60 which is complementary with shoulder 56 so that when body sections 14 and 16 are pivoted to a closed position, shoulder 56 is received in recess 60. A tongue 62 having an inclined surface 64 projects upwardly relative to recess 60. Tongue 62 is dimensioned and correspondingly alignable so that when body sections 14 and 16 are pivoted to the closed position, tongue 62 engages slot 58 and incline surface 64 interacts with engagement surface 59 to firmly interlock the blade retainer portions of body sections 14 and 16. In a preferred embodiment, inclined surface 64 of tongue 62 is inclined at an angle of approximately 22 degrees relative to the longitudinal parting plane defined by opposing abutting surfaces 22 and 24. Any angle in the range of approximately 10 to 30 degrees relative to the longitudinal parting plane will provide a sufficient interlocking engagement between incline surface 64 and engagement surface 59. A projection groove 66 (shown in dashed lines) which is complementary to projection 54 is also located adjacent to tongue 62 to accommodate projection 54 when the body sections are pivoted to the closed position.

A blade storage compartment 38 is conveniently formed in the hollow rear portion of body section 14. Compartment 38 may be employed for housing spare blades. Blade storage compartment 38 may be defined by a plurality of ribs which project interiorly from side wall 18 of body section 14 to terminate at the longitudinal plane defined by the abutting shoulders 22 and 24. Body sections 14 and 16 cooperate in a closed position to close the blade storage compartment.

With reference to FIGS. 1 and 6, the handle portions of the body sections are further provided at the rear portion thereof with transverse openings 70 and 72. Transverse opening 70 is of a concentric stepped configuration having an outer diameter which is less than the diameter of the inner portion of the opening. A button 74 is slidably received in transverse opening 70 and is dimensioned to be substantially commensurate with the dimensions of transverse opening 70, excepting that the outer end of the button is projectable beyond side wall 18 of body section 14. Transverse opening 72 comprises a stepped configuration the inner portion of which is alignable with transverse opening 70 when the body sections are pivoted to the closed position. The inner portion of transverse opening 72 has a diameter equal to that of the diameter of the inner portion of transverse opening 70 and is alignable therewith so that button 74 may be pushed to slide into the inner portion of transverse opening 72 as shown in FIG. 6. A rim 76 defined at the transition between the outer and inner portions of the opening 72 defines a stop for button 74. The location of rim 76 and dimensions of button 74 are such that button 74 may only be partially received in the inner portion of opening 72.

When body sections 14 and 16 are moved to a closed position, button 74 may be pushed to slide into transverse opening 72 by depressing the projecting portion of button 74 through the exterior side of side wall 18. The longitudinal parting plane defined by abutting shoulders 22 and 24 intersects through an intermediate portion of button 74 so that button 74 is received in opening 72, body sections 14 and 16 are essentially locked in place and pivotal motion relative to pivot 34 is prevented. A resilient retaining ring 80 may be circumferentially mounted to button 74 to bias against the walls of the outer portion of transverse opening 70 to thereby act to releasably retain the button in position. The locking mechanism provided by button 74 and transverse openings 70 and 72 may be released by merely pushing the button out of transverse opening 72 by depressing same through the outer portion of transverse opening 72. The button may be depressed so that the inner surface thereof substantially coincides with the longitudinal parting plane defined by abutting shoulders 22 and 24. Sections 14 and 16 are now free to pivot relative to each other, and thus the knife can be pivoted to an open position.

With further reference to FIGS. 1 and 3, the blade opening 52 is preferably dimensioned so that when the body sections 14 and 16 are pivoted to the closed position without mounting a blade in the blade recess 36, the uniform width of the blade opening 52 is equal to or slightly less than the width of the blade to be mounted in the blade recess. With reference to FIG. 4, when the knife is pivoted to an open position, and a blade is mounted in the blade recess, the repivoting of the body sections to a closed position results in the blade forcefully contacting against the inner portions of body sections 14 and 16 which define the blade recess 36 so that the blade is securely positioned between the body sections of the blade retainer portion of the knife. The spring biased pivot 34 also functions to absorb any outward deflection of the body sections caused by the blade and to bias the body sections firmly against the blade. The inclined surface 64 of tongue 62 cooperates with surface 59 to interlock the body sections to thereby prevent slippage and increase the stability of the blade during heavy duty cutting use. Inadvertent separation of body sections 14 and 16 is also minimized by the relatively firm wedging interlocking configuration provided at the blade retainer portion of the knife.

In a preferred form, the width of blade opening 52 is 0.020 inches when the holder is in a closed position without a blade being mounted in the blade recess. The thickness of a blade to which the utility knife is particularly adapted is approximately 0.025 inches. Blade opening 52 in a closed position is preferably of a width ranging from 0 to 0.008 inches less than the thickness of the blade.

From the foregoing description, it can be seen that the present invention provides a utility knife employing a non-retractable detachable blade which can be easily pivoted from a closed position wherein the utility knife is conditioned for heavy duty cutting use, to an open position wherein the knife blade may be repositioned or replaced. When it is desirable to replace or reposition a blade, the holder is unlocked by depressing button 74 through transverse opening 72 of body section 16. Body sections 14 and 16 are then pivoted to an open position such as illustrated in FIG. 1 and blade 30 is either repositioned in blade recess 36 by appropriately aligning a notch on the blade with projection 54 or the blade is removed from blade recess 36. A new blade, which may be stored in compartment 68, is then mounted in the blade recess and body sections 14 and 16 are pivoted to move to the closed position. Proximate the termination of the pivot to the closed position, the blade firmly engages against the forward sides of body sections 14 and 16 and the tongue firmly engages in slot 58 to rigidly interlock the body sections and to rigidly secure the blade in position. Button 74 is then pushed to slide into transverse opening 72 by depressing the projection portion of the button inwardly from the external portion of side wall 18. The utility knife is now in condition for heavy duty use. Alternate locking means may also be provided to lock the body sections in a closed position.

The foregoing description is set forth for purposes of illustrating the present invention and should not be deemed a limitation thereof. Accordingly, various modifications, adaptations and alternatives to the present invention may occur to one skilled in the art.

What is claimed is:

1. A knife holder for a utility knife employing a detachable blade of a type having a primary cutting edge and an opposite back edge, comprising:

a pair of complementary opposing elongated body sections having opposed mating surfaces for mating engagement along a parting line and exterior surfaces forming a handle portion and blade enclosure means to interiorly receive and at least partially enclose said detachable blade;

pivot means connecting said sections so that said sections are pivotally moveable between an open position and a closed position, said pivot means extending transverse of said opposed surfaces and being intermediate said blade enclosure means and handle portion;

said sections cooperating in the closed position to provide the blade enclosure means, said blade enclosure means terminating at a front tip of said sections to define a blade opening;

one of said body sections having an elongated shoulder projecting transversely across the parting line and extending rearwardly from said tip to form a blade canopy, said canopy shoulder having a first exterior surface generally conforming with the exterior surfaces of said sections when said holder is in the closed position, said canopy having a second interior surface generally opposite said first surface partially defining said blade enclosure means and being abuttable by the back edge of a blade received in said enclosure means, and a slot on the opposite side of said parting line from said one body section so as to overlie said other body section in the closed position;

the exterior surface of said other body section forming a recess complementary with said canopy shoulder for mating reception therewith, a freely projecting tongue extending outwardly from said recess forming exterior surface toward said shoulder for cooperative reception in said slot to interlock said body sections in close interfitting relationship; and a locking means in the handle portion to releasably secure said sections in a closed position.

2. The knife holder of claim 1 wherein said tongue includes an abutment surface which engages the slot, said abutment surface being inclined at an angle ranging from approximately 10 degrees to 30 degrees relative to a plane of separation defined by said opposed surfaces of the body sections.

3. The knife holder of claim 1 wherein the blade enclosure means further comprises a projection adapted to secure a blade in a longitudinal position relative to said blade opening.

4. The knife holder of claim 1 wherein the tongue and slot are spaced rearwardly from the blade opening.

5. The knife holder of claim 1 wherein the pivot means is a spring biased pivot joint.

6. The knife holder of claim 1 further comprising a receptacle for storing blades, said receptacle located in said handle portion between opposing body sections.

7. The knife holder of claim 1 wherein the body sections have alignable transverse openings, said locking means comprising a button received in one transverse opening and transversely slidable to be partially received in the other transverse opening to thereby secure the sections in a closed position.

8. The knife holder of claim 7 wherein a portion of the button projects outwardly from the handle portion when the locking means is released.

9. The knife holder of claim 5 wherein the blade opening has a uniform width, the blade opening width being dimensioned to be slightly less than the thickness of a blade to be retained by said blade enclosure means.

10. The knife holder of claim 9 wherein said holder is adapted so that upon mounting a blade in the blade enclosure means and pivotally moving the sections to a closed position, the opposing body sections are forced outwardly relative to each other in the vicinity of the blade enclosure portion.

11. The knife portion of claim 10 further comprising a blade mounted in said blade enclosure means, a portion of said blade extending through said blade opening to present a cutting edge forward of said tip.

12. The knife holder of claim 11 wherein the blade opening has a width ranging between approximately 0 to 0.008 inches less than the thickness of the blade.

13. The knife holder of claim 11 wherein the body sections are biased to contact against the blade to firmly secure the blade in position.

14. A knife holder for a utility knife employing a detachable blade of a type having a primary cutting edge and an opposite back edge, comprising:

a pair of complementary opposing elongated body sections adapted for mating engagement along a parting line and having exterior surfaces forming a handle portion and a blade enclosure means to interiorly receive and at least partially enclose said detachable blade;

connecting means intermediate said blade enclosure means and handle portion to securely connect said body sections in a closed position;

said body sections cooperating in the closed position to provide said blade enclosure means, said enclosure means terminating in the front tip of said sections to define a blade opening;

one of said body sections having an elongated shoulder projecting transversely across the parting line and extending rearwardly from said tip to form a blade canopy, said canopy shoulder having a first exterior surface generally conforming with the exterior surfaces of said sections when said holder is in the closed position, said canopy having a second interior surface generally opposite said first surface partially defining said blade enclosure portion and being abuttable by the back edge of a blade received in said enclosure portion, and a slot on the opposite side of said parting line from said one body section so as to overlie said other body section in the closed position; and the exterior surface of said other body section forming a recess complementary with said canopy shoulder for mating reception therewith, a freely projecting tongue extending outwardly from said recess forming exterior surface toward said shoulder for cooperative reception in said slot to interlock said body sections in close interfitting relationship.

15. The knife holder of claim 14 further comprising a blade mounted in said blade enclosure portion so that in the closed position, a portion of said blade extends through the blade opening to present a cutting edge forward of said tip and the body sections clamp against the blade to firmly secure the blade in position.

16. The knife holder of claim 15 wherein the reception of the tongue in the slot forces the body sections to clamp against the blade.

17. A knife holder for a utility knife employing a detachable blade of a type having a primary cutting edge and an opposite back edge, comprising:

a pair of complementary opposing elongated body sections adapted for mating engagement along a parting line and having exterior surfaces forming a handle portion and a blade enclosure means to interiorly receive and at least partially enclose said detachable blade;

connection means extending transversely to said body sections to connect said sections in a closed position;

said sections cooperating in the closed position to provide said blade enclosure means, said enclosure means terminating at a front tip of said sections to define a blade opening;

one of said body sections having an elongated shoulder projecting transversely across the parting line and extending rearwardly from said tip to form a blade canopy, said canopy shoulder having a first exterior surface generally conforming with the exterior surfaces of said sections when said holder is in the closed position, said canopy having a second interior surface generally opposite said first surface partially defining said blade enclosure portion and being abuttable by the back edge of a blade received in said enclosure portion, and a slot on the opposite side of said parting line from said one body section so as to overlie said other body section in the closed position; and the exterior surface of said other body section forming a recess complementary with said canopy shoulder for mating reception therewith and a freely projecting tongue extending outwardly from said recess forming exterior surface toward said shoulder for cooperative reception in said slot to interlock said body sections in close interfitting relationship.

18. The knife holder of claim 14 further comprising locking means to releasably secure said sections in a closed position.

* * * * *

UNITED STATES PATENT AND TRADEMARK OFFICE

CERTIFICATE OF CORRECTION

PATENT NO. : 4,524,518

DATED : June 25, 1985

INVENTOR(S) : Robert West

It is certified that error appears in the above-identified patent and that said Letters Patent is hereby corrected as shown below:

Claim 11, line 1, "portion" is changed to --holder--.

Signed and Sealed this

*Fifteenth* Day of *April 1986*

[SEAL]

*Attest:*

DONALD J. QUIGG

*Attesting Officer*

*Commissioner of Patents and Trademarks*